US009809025B2

(12) United States Patent
Rodriguez

(10) Patent No.: US 9,809,025 B2
(45) Date of Patent: Nov. 7, 2017

(54) PRINTING PEN AND PRINTING SYSTEM

(71) Applicant: HEWLETT-PACKARD DEVELOPMENT COMPANY, L.P., Houston, TX (US)

(72) Inventor: Jose Miguel Rodriguez, San Diego, CA (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 15/303,284

(22) PCT Filed: Apr. 23, 2014

(86) PCT No.: PCT/US2014/035189
§ 371 (c)(1),
(2) Date: Oct. 11, 2016

(87) PCT Pub. No.: WO2015/163873
PCT Pub. Date: Oct. 29, 2015

(65) Prior Publication Data

US 2017/0028720 A1 Feb. 2, 2017

(51) Int. Cl.
*B41J 2/145* (2006.01)
*B41J 2/045* (2006.01)

(52) U.S. Cl.
CPC ..... *B41J 2/145* (2013.01); *B41J 2/0457* (2013.01); *B41J 2/0458* (2013.01); *B41J 2/04541* (2013.01)

(58) Field of Classification Search
CPC ... B41J 2/32; B41J 29/13; B41J 15/042; B41J 17/32; B41J 32/00; B41J 35/28; B41J 2/04541; B41J 2/0457; B41J 2/0458; B41J 2/145
See application file for complete search history.

(56) References Cited

U.S. PATENT DOCUMENTS

| | | | | |
|---|---|---|---|---|
| 6,663,209 | B2 | 12/2003 | Yoshida | |
| 8,550,598 | B2 * | 10/2013 | Owaki | B41J 2/17513 347/42 |
| 2003/0103106 | A1 | 6/2003 | Silverbrook | |
| 2010/0013889 | A1 | 1/2010 | Yamamoto et al. | |
| 2012/0188308 | A1 | 7/2012 | Fang et al. | |
| 2012/0249631 | A1 | 10/2012 | Puigardeu et al. | |
| 2013/0010022 | A1 | 1/2013 | Larson et al. | |

FOREIGN PATENT DOCUMENTS

| | | |
|---|---|---|
| EP | 2301753 | 3/2011 |
| JP | H11277774 | 10/1999 |
| WO | WO-2013076510 | 5/2013 |

* cited by examiner

*Primary Examiner* — Lamson Nguyen
(74) *Attorney, Agent, or Firm* — Fabian Van Cott

(57) ABSTRACT

A printing system comprising a pen comprising a number of print bars; each print bar comprising a number of printheads in which the printheads are grouped to a number of printheads from each of the number or print bars, the grouped printheads forming a slice and in which the printheads of the slice are electrically coupled to a common power supply unit. A printing pen comprising a number of print bars in which each of the number of print bars comprises a number of printheads, in which the number of printheads are grouped together to form a slice, the slice comprising a printhead from each of the print bars, and in which the slice is powered by a common power supply unit.

20 Claims, 4 Drawing Sheets

PRINTING PEN AND PRINTING SYSTEM

BACKGROUND

An inkjet printing press may include any number of individual print bars each of which may further comprise any number of individual printheads. Firing of inkjet heads use an amount of electrical power that is distributed among the printheads of each print bar. Printheads may be, for example, piezoelectric or thermal printheads.

BRIEF DESCRIPTION OF THE DRAWINGS

The accompanying drawings illustrate various examples of the principles described herein and are a part of the specification. The illustrated examples are given merely for illustration, and do not limit the scope of the claims.

Throughout the drawings, identical reference numbers designate similar, but not necessarily identical, elements.

DETAILED DESCRIPTION

Figure 1:
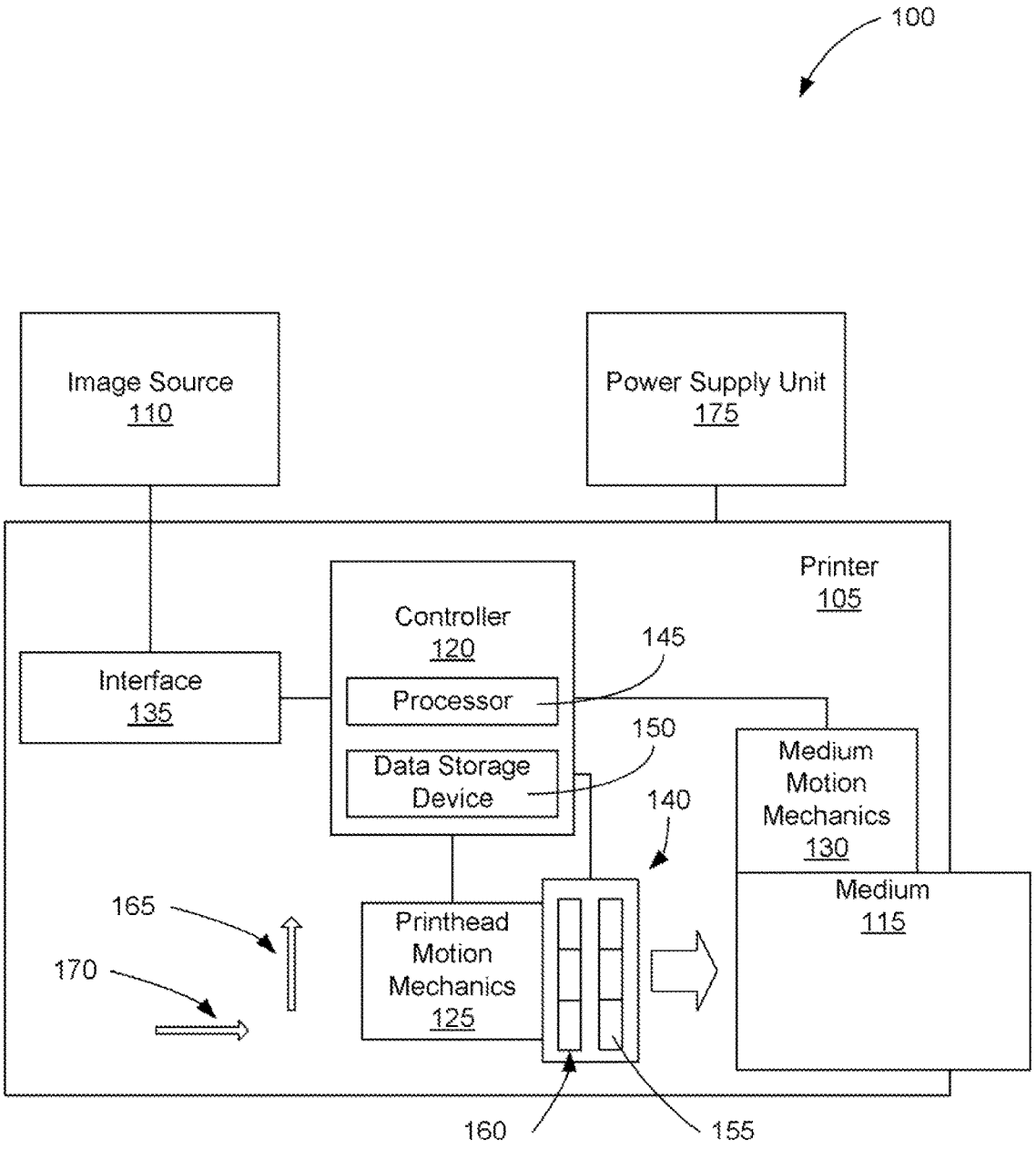
FIG. 1 is a block diagram of a printing system according to one example of the principles described herein.

As mentioned above, printers or presses may comprise a number of print bars that comprise a number of printheads. The print bars may each eject a different color of ink, or other printing fluid, from the printheads therein. As mentioned above, these print bars may comprise printheads that may be thermal or piezoelectric inkjet printheads. In the example where the printheads are thermal printheads, electricity is provided to a heater included within each of a number of chambers defined within the printhead. The electrical charge heats up the heater causing a rapid vaporization of the fluid in the chamber to form a bubble, which causes a large pressure increase, propelling a droplet of fluid out of the printhead and onto a media. With the piezoelectric printhead, a piezoelectric material is used instead of a heating element such that application of an electrical charge to the piezoelectric material causes the piezoelectric material to change shape, which generates a pressure pulse in the fluid forcing a droplet of fluid from the chamber. The electrical charge is provided via a power supply unit. However, operation of the press may use relatively large amounts of power. Additionally, where relatively large presses are built for some customers, a power supply unit that can provide enough power to run the press may be difficult to purchase and operate.

The specification, therefore, describes a printing system comprising a pen comprising a number of print bars; each print bar comprising a number of printheads in which the printheads are grouped to a number of printheads from each of the number or print bars, the grouped printheads forming a slice and in which the printheads of the slice are electrically coupled to a common power supply unit.

The specification further describes a printing pen comprising a number of print bars in which each of the number of print bars comprises a number of printheads, in which the number of printheads are grouped together to form a slice, the slice comprising a printhead from each of the print bars, and in which the slice is powered by a common power supply unit.

The specification additionally describes a method of manufacturing a pen of a printing system, comprising grouping a number of printheads into a number of slices and electrically coupling a power supply unit to each slice.

As used in the present specification and in the appended claims, the term "pen" is meant to be understood broadly as a group of all printheads used by a single printer to eject a fluid onto a substrate. In one example the fluid is ink and the substrate is paper.

Additionally, as used in the present specification and in the appended claims, the term 'print bar' is meant to be understood broadly as any group of printheads of the pen. In one example, the group of printheads may be aligned perpendicular to the direction the medium is fed through the printer. In another example, a number of print bars may each eject a different color of ink onto the medium. In yet other examples, a number of print bars may eject the same color of ink. In still another example, a number of print bars may be provided such that a first plurality of print bars among the number of print bars eject the same color while a second plurality of print bars among the number of print bars eject a different color.

Further, as used in the present specification and in the appended claims, the term "peak power supply" is meant to be understood broadly as the power used to fire a fluid from all printheads within all print bars of the pen over a single period of time. In one example, the peak power is not maintained indefinitely.

Still further, as used in the present specification and in the appended claims, the term "fluid limit" is meant to be understood broadly as the maximum amount of fluid a medium may absorb within any given area of the medium.

Even still further, as used in the present specification and in the appended claims, the term "a number of" or similar language is meant to be understood broadly as any positive number comprising 1 to infinity; zero not being a number, but the absence of a number.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an example" or similar language means that a particular feature, structure, or characteristic described in connection with that example is included as described, but may not be included in other examples.

Turning now to FIG. 1 a printing system (100) according to one example described herein is shown. The printing system (100) may comprise a printer (105), an image source (110), and a medium (115). The printer (105) may comprise a controller (120), printhead motion mechanics (125), medium motion mechanics (130), an interface (135), and a pen (140). The controller (120) may comprise a processor (145) and a data storage device (150). Each of these will now be described in more detail.

The printer (105) may comprise an interface (135) to interface with an image source (110). The interface (135) may be a wired or wireless connection connecting the printer (105) to the image source (110). The image source may be any source from which the printer (105) may receive data describing a print job to be executed by the controller (120) of the printer (105) in order print an image onto the medium (115). In one example, the image source may be a computing device in communication with the printer (105).

The interface (135) enables the printer (105) and specifically the processor (120) to interface with various other hardware elements like the image source (110), external and internal to the printer (105). For example, the interface (135) may interface with an input or output device such as, for example, display device, a mouse, or a keyboard. The interface (135) may also provide access to other external devices such as an external storage device, a number of network devices such as, for example, servers, switches, and routers, client devices, other types of computing devices, and combinations thereof.

The processor (145) may include the hardware architecture to retrieve executable code from the data storage device (150) and execute the executable code. The executable code may, when executed by the processor (145), cause the processor (145) to implement at least the functionality of printing on the medium (115), and actuating the printhead and medium motion mechanics (125, 130), according to the methods of the present specification described herein. The executable code may, when executed by the processor (145), cause the processor (145) to implement the functionality of providing instructions to the power supply unit (175) such that the power supply unit (175) provides power to the pen (140) and more specifically, individual printheads (155) of a number of print bars (160) that comprise the pen (140).

The data storage device (150) may store data such as executable program code that is executed by the processor (145) or other processing device. The data storage device (150) may specifically store computer code representing a number of applications that the processor (145) executes to implement at least the functionality described herein.

The data storage device (150) may include various types of memory modules, including volatile and nonvolatile memory. For example, the data storage device (150) of the present example includes Random Access Memory (RAM), Read Only Memory (ROM), and Hard Disk Drive (HDD) memory. Many other types of memory may also be utilized, and the present specification contemplates the use of many varying type(s) of memory in the data storage device (150) as may suit a particular application of the principles described herein. In certain examples, different types of memory in the data storage device (150) may be used for different data storage needs. For example, in certain examples the processor (145) may boot from Read Only Memory (ROM) (150), maintain nonvolatile storage in the Hard Disk Drive (HDD) memory, and execute program code stored in Random Access Memory (RAM).

Generally, the data storage device (150) may comprise a computer readable medium, a computer readable storage medium, or a non-transitory computer readable medium, among others. For example, the data storage device (150) may be, but not limited to, an electronic, magnetic, optical, electromagnetic, infrared, or semiconductor system, apparatus, or device, or any suitable combination of the foregoing. More specific examples of the computer readable storage medium may include, for example, the following an electrical connection having a number of wires, a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a computer readable storage medium may be any tangible medium that can contain, or store computer usable program code for use by or in connection with an instruction execution system, apparatus, or device. In another example, a computer readable storage medium may be any non-transitory medium that can contain, or store a program for use by or in connection with an instruction execution system, apparatus, or device.

The printhead and medium motion mechanics (125, 130) comprise mechanical devices that may move the pen (140) and medium (115) respectively. Instructions to move the pen (140) and medium (115) may be received and processed by the controller (120) and signals may be sent to the pen (140) and medium motion mechanics (130) from the controller (120).

As discussed above, the pen (140) may comprise a number of nozzles. In some examples, the pen (140) may comprise a number of print bars (160) each used to eject one of a number of colors of ink or types of fluids. In the example, shown in FIG. 1, the pen (140) comprises two print bars (160). However, a printer (105) may comprise a plurality of print bars (160) and FIG. 1 is meant merely as an example. For references purposes, FIG. 1 comprises pen axis arrow (165) and a scan axis arrow (170). The pen axis arrow (165) indicates the axis of the print bars (160) The scan axis arrow (170) indicates the direction at which the pen (140) scans relative to the medium (115).

Figure 2:
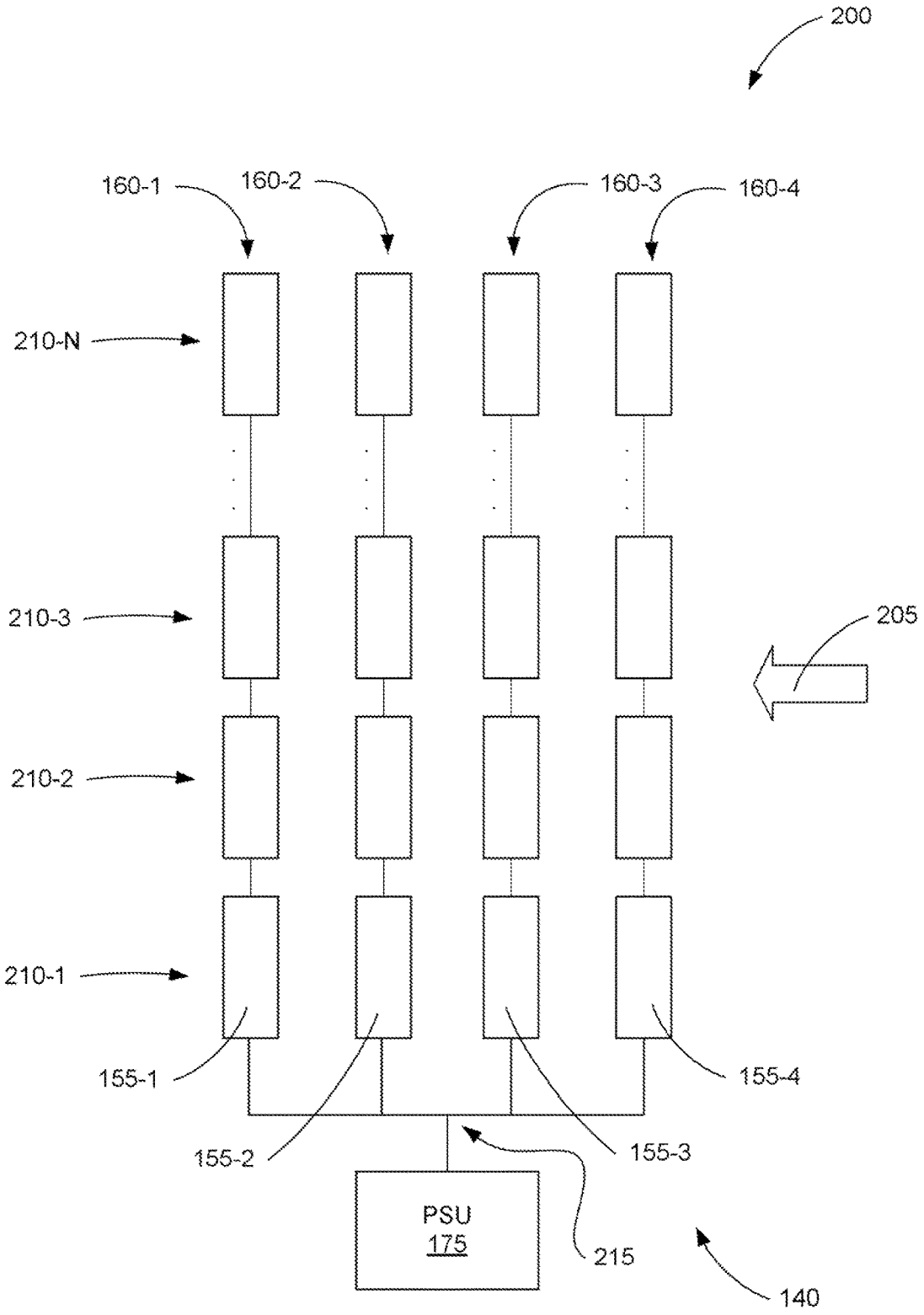
FIG. 2 is a block schematic diagram showing the power architecture of a printer pen.

In some printing systems (100) the pen (140) is powered by the power supply (175) such that each individual print bar (FIG. 2, 160-1, 160-2, 160-3, 160-4; generally 160) has power supplied to it. FIG. 2 is a block schematic diagram (200) showing this power architecture according to this example. In this example, each print bar (160) runs perpendicular to the direction (205) that the medium (FIG. 1, 115) progresses through the printer (FIG. 1, 100). The individual print bars (160) may each eject a different printing fluid. In one example, the pen (140) may comprise a cyan ink print bar (160-2), a magenta ink print bar (160-3), a yellow ink print bar (160-4) and a black ink print bar (160-1); each print bar (160) delivering to the medium (FIG. 1, 115) their respective colored inks. Other examples exist where multiples of the individual inks are supplied to the medium (FIG. 1, 115) using multiple print bars (160) that distribute that color of ink. In another example, the inks used may vary in colors and color models such as a red, green, and blue color model.

Each print bar (160) comprises a number of printheads (155) that are divided into slices (210-1, 210-2, 210-3, 210-N; generally 210). Each slice (210) comprises a single printhead (155) from each of the print bars (160). In one example, the slices (210) comprise a printhead (155) from each print bar (160) that is directly parallel to the others with reference to the direction (205) of the medium (FIG. 1, 115) as fed through the printer (FIG. 1, 105). Thus a slice (210-1) may comprise, for example, four printheads (155-1, 155-52, 155-3, 155-4) with each printhead distributing or ejecting a color specific to the print bar (160) that printhead (155) is a member of. Although FIG. 2 shows a spacing between each printhead (155), the spacing is presented to show the electrical connection between each printhead (155). As such, the spacing may or may not exist in the physical layout of the print bars (160) as described herein.

The pen (140) may be powered by the power supply unit (175) such that the power supply unit (175) provides power to each print bars (160). In one example, the power supplied to the pen (140) may be direct current converted from alternating current by the power supply unit (175). The print bars (160) may be connected to the power supply unit (175) at a common connection point (215). In one example, the connection point (215) may be relatively closer to the power supply unit (175) than to the pen (140). In another example, the connection point (175) may be relatively closer to the pen (140) than to the power supply unit (175). The power architecture in FIG. 2 provides for the least amount of wiring included in the system. However, the power architecture shown in FIG. 2 uses the power supply unit (175) to provide a relatively higher average power output and a higher peak power output than that described in connection with FIG. 3 below. In this case the maximum average power output is calculated by determining the speed that the medium (FIG. 1, 115) is passed through the printer (FIG. 1, 105), the fluid limit of the medium (115), the width of the pen (FIG. 1, 140), and the power of an individual printhead (FIG. 1, 155) to eject a unit of fluid or the efficiency of that printhead (FIG. 1, 155). For example, the speed of the medium (FIG. 1, 115) passed through the printer (FIG. 1, 105) will determine how quickly fluid is to be deposited onto the medium (FIG. 1, 115) and, consequently, will determine how much power is consumed to fire the piezoelectric or thermal inkjets. The fluid limit of the medium (FIG. 1, 115) also causes the individual piezoelectric or thermal inkjets to fire more or less frequently because of the medium (FIG. 1, 115) capability or incapability to absorb fluid and present an acceptable printed product by achieving an acceptable optical density. Taking these constants, the maximum average power for each print bar (160) is the power to drive a single printhead (FIG. 1, 155) to the maximum optical density multiplied by the number of printheads (FIG. 1, 155) on the print bar (160). Consequently, where the speed of the medium (FIG. 1, 115) passing through the printer (FIG. 1, 105) and the fluid limit of the medium (FIG. 1, 115) are set as constants, these constants are multiplied to the following equation:

$$N*P \quad \text{(Equation 1)}$$

where P is the power used to drive a single printhead (155) to the paper fluid limit and N is the number of printheads on each print bar (160). Similarly, the peak power, as determined in FIG. 2, can be determined by multiplying the above constants by the following equation:

$$B*N*P \quad \text{(Equation 2)}$$

where B is the lumber of print bars (160) on the pen (140).

Figure 3:
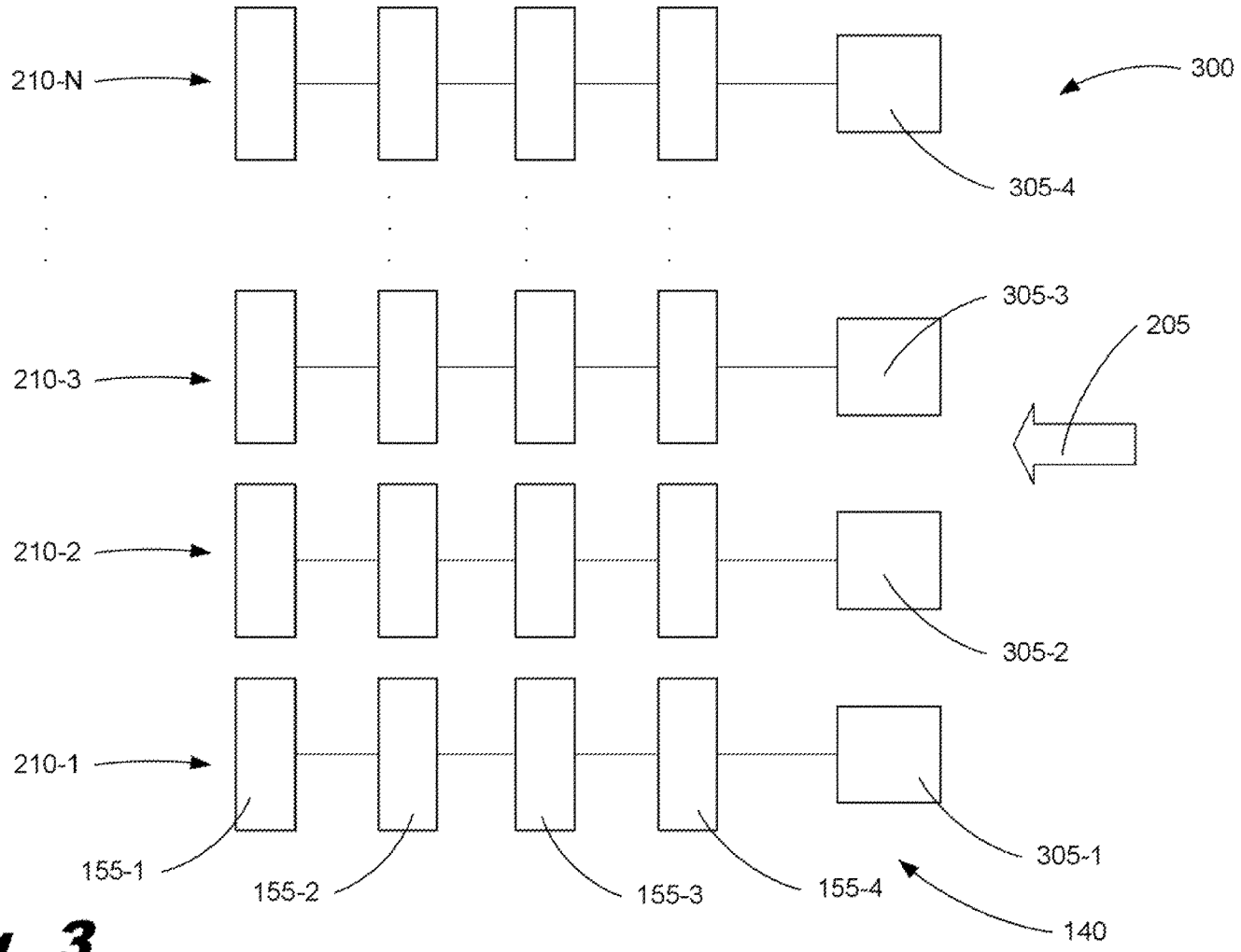
FIG. 3 is a block diagram showing the power architecture of a pen according to one example of the principles described here.

Turning now to FIG. 3, a block diagram (300) showing the power architecture of a pen (140) according to one example of the principles described herein. In this example, instead of a single power supply unit (FIG. 2, 175) supplying power to all print bars (FIG. 2, 160), a number of power supply units (305-1, 305-, 305-3, 305-4; generally 305) supply power to a number of printheads (155) within a slice (210-1, 210-2, 210-3, 210-4; generally 210). For example, a first power supply unit (305-1) may supply power to a number of printheads (155-1, 155-2, 155-3, 155-4) within the slice. In this case, the first power supply unit (305-1) may be relatively physically smaller than the power supply unit described in FIG. 2. Additionally, the power supply unit (305-1) may supply less power because less power is now used to run a limited number of printheads (155).

In comparison to the average power architecture shown in FIG. 2, the average power architecture of FIG. 3 is P; the power used to drive a single printhead (155) within the slice (210). Similarly, in comparison to the peak power supply of FIG. 2, the peak power supply of FIG. 3 is:

$$M*P \quad \text{(Equation 3)}$$

where M is the number of printheads (155) in each slice (210).

The power architecture described in connection with FIG. 3 provides for a number of power supply units that, together, are relatively less expensive than a single larger power supply unit. Larger power supply units may be more expensive and relatively more difficult to manufacture and purchase. Although a number of larger power supply units may be used in parallel in FIG. 2, the use of the power supplies in such a way requires a power supply analysis for each printing press or printer before the paralleled power supply units can be used. This requires the manufacturer to perform this analysis for each printer model manufactured. This increase the cost of manufacturing a printing system in both manual labor costs, analytics costs, and additional hardware costs. In contrast, the power supply units shown in FIG. 3 can be manufactured relatively easily, may be smaller, and may be individualized. Additionally, the number of potential manufacturers of these relatively cheaper and smaller power supply units may be relatively larger than those manufacturers of the larger single power supply units. As a result, additional vendors may be available to produce larger quantities of powers supply units making these power supply units relatively more available to any consumer. Further, where a user wishes to expand the width of the press, the user may add the additional slices comprising their individual printheads with each slice having its own dedicate power supply unit. As such, the press is more easily expandable than that described in connection with FIG. 2 and addition of more slices does not comprise the extra process of retesting a centralized power supply unit to determine if the power supply unit can provide the power used to drive all printheads.

Figure 4:
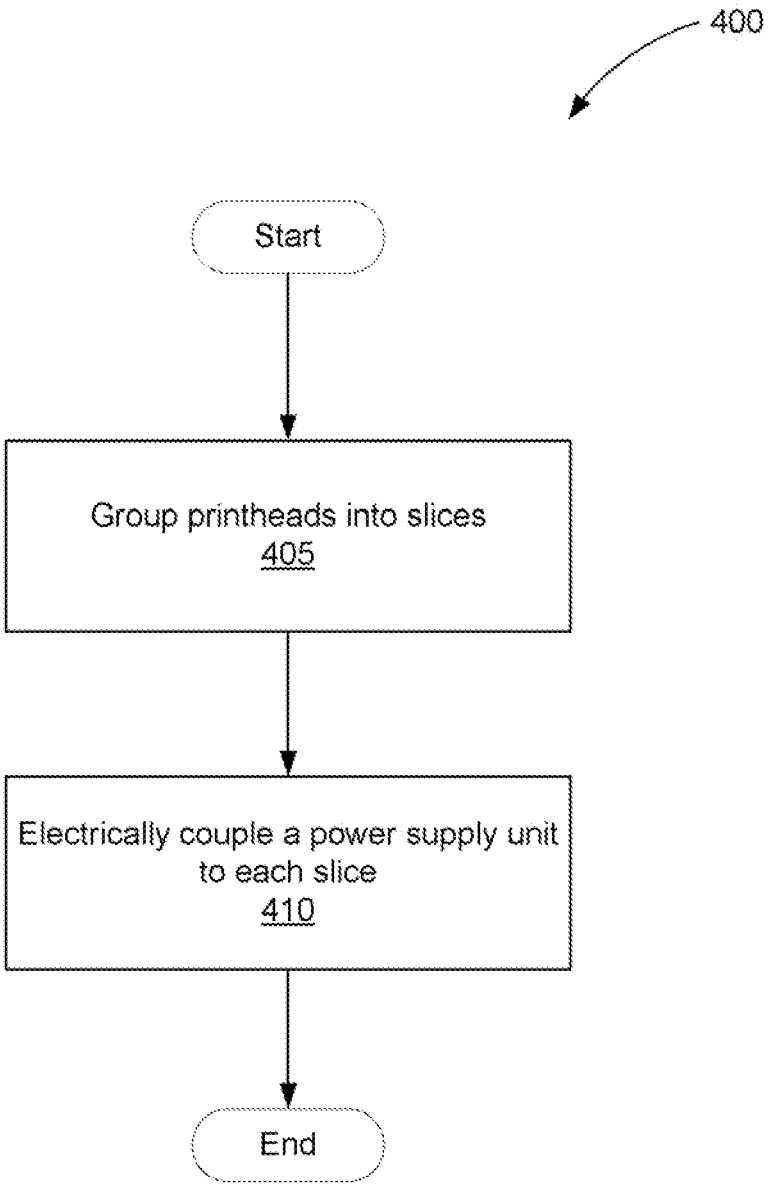
FIG. 4 is a flowchart showing a method of manufacturing a pen of a printing device according to one example of the principles described herein.

FIG. 4 is a flowchart showing a method (400) of manufacturing a pen (FIG. 1, 140) of a printing device (FIG. 1, 105) according to one example of the principles described herein. The method may begin with grouping a number of printheads (FIG. 1, 155) together into slices (FIG. 3, 210). As described above, the number of printheads (FIG. 1, 155) that form the group of printheads (FIG. 1, 155) are formed from those printheads (FIG. 1, 155) run parallel to the feed direction of the medium (FIG. 1, 115). In one example, the individual groups of printheads (FIG. 1, 155) comprise a printhead (FIG. 1, 155) from each of the print bars (FIG. 1, 160). In one example, each print bar (FIG. 1, 160) may eject a different color of ink onto the medium (FIG. 1, 115).

The method (400) may further comprise electrically coupling a power supply unit (FIG. 1, 175) to each slice (FIG. 3, 210). As described above, the number of printheads (FIG. 1, 155) coupled to a single power supply unit (FIG. 1, 175) is equal to the number of print bars (FIG. 1, 160) within the pen (FIG. 1, 140). Grouping (405) and electrically coupling each of these groups called slices to a power supply unit (FIG. 1, 175) provides for easy replacement of slices (FIG. 3, 210) and expansion of the pen (FIG. 1, 140) by adding more slices (FIG. 3, 210) as desired. This may be done on site without the extra process of performing an analysis of whether a central power supply unit can provide an appropriate amount of power to the printer (FIG. 1, 105).

Although, FIG. 4 shows the printheads (FIG. 1, 155) being grouped before they are electrically coupled, other examples exist where the manufacture of the pen (FIG. 1, 140) may comprise additional processes or processes completed in different orders. For example, the individual printheads (FIG. 1, 155) may be inserted into the pen (FIG. 1, 140) after the pen (FIG. 1, 140) has been manufactured with an existing number of printheads (FIG. 1, 155). In this example, the grouping (405) of the printheads (FIG. 1, 155)

into slices may occur after or simultaneously to a new power supply unit being coupled to the individual printheads (FIG. 1, 155).

The preceding description has been presented to illustrate and describe examples of the principles described. This description is not intended to be exhaustive or to limit these principles to any precise form disclosed. Many modifications and variations are possible in light of the above teaching.

What is claimed is:

1. A printing system comprising:

a pen comprising a number of print bars; each print bar comprising a number of printheads;

in which the printheads are grouped with a number of printheads from each of the number of print bars, the grouped printheads forming a slice; in which the slice comprises printheads from each print bar that run parallel with each other and parallel with respect to the direction a medium is passed under the pen; and in which the printheads of the slice are electrically coupled to a common power supply unit.

2. The printing system of claim 1, in which the power supply unit provides power to those printheads grouped in the slice.

3. The printing system of claim 1, in which the pen may be expanded perpendicularly with respect to the direction a medium is passed under the pen by adding a new slice comprising a new group of printheads to the pen.

4. The printing system of claim 3, in which the new slice comprises a number of new printheads equal to the number of existing print bars.

5. The printing system of claim 1, in which the printheads of each of the print bars eject a different color of ink.

6. The printing system of claim 5, in which the number of print bars is four and a single print bar ejects one of a cyan colored ink, a magenta colored ink, a yellow colored ink, and a black colored ink.

7. A printing pen comprising:

a number of print bars, in which each of the number of print bars comprises a number of printheads;

in which the number of printheads are grouped together to form a slice, the slice comprising a printhead from each of the print bars;

in which the slice is to be powered by a common power supply unit; and wherein the printing pen may be expanded perpendicularly with respect to the direction a medium is passed under the printing pen by adding a new slice comprising a new group of printheads to the printing pen.

8. The pen of claim 7, in which the slice comprises those printheads from each of the print bars that run parallel with each other and parallel with respect to the direction a medium is passed under the pen.

9. The pen of claim 7, in which the power supply unit provides power to those printheads grouped in the slice.

10. The pen of claim 7, in which the printheads of each of the print bars eject a different color of ink.

11. The pen of claim 10, in which the number of print bars is four and a single print bar ejects one of a cyan colored ink, a magenta colored ink, a yellow colored ink, and a black colored ink.

12. The pen of claim 7, in which the new slice comprises a number of new printheads equal to the number of existing print bars.

13. A method of manufacturing a pen of a printing system, comprising:

grouping a number of printheads of a print bar into a number of perpendicularly arranged slices;

electrically coupling a power supply unit to each slice; and expanding the pen perpendicularly with respect to the direction a medium is passed under the pen by adding a new slice comprising a new group of printheads to the pen and the new slice comprises a number of new printheads equal to the number of existing print bars.

14. The method of claim 13, in which the slices each comprise printheads from each of a number of print bars, the printheads of each slice running parallel with each other and parallel with respect to the direction a medium is passed under the pen.

15. The printing pen of claim 7, in which the new slice comprises a number of new printheads equal to the number of printhead in the existing print bars.

16. The printing system of claim 1, in which the printheads of each of the slices are coupled to individual power supply units.

17. The printing system of claim 16, wherein each of the individual power supply units adds a printhead to its respective electrical circuit when a new slice comprising a new group of printheads is added to the pen.

18. The pen of claim 8, in which the power supply unit provides power to those printheads in each print bar individually.

19. The method of claim 13, in which the printheads of each of the print bars eject a different color of ink.

20. The method of claim 13, in which the number of print bars is four and a single print bar ejects one of a cyan colored ink, a magenta colored ink, a yellow colored ink, and a black colored ink.

* * * * *